United States Patent [19]

Marroquin

[11] 4,160,300

[45] Jul. 10, 1979

[54] HAMMER FOR FORMING AN UNDERCUT FASTENER DRIVING SLOT

[75] Inventor: Emilio R. Marroquin, Lawndale, Calif.

[73] Assignee: Litton Systems, Inc., Beverly Hills, Calif.

[21] Appl. No.: 833,540

[22] Filed: Sep. 15, 1977

[51] Int. Cl.[2] ..... B23G 9/00; B21K 1/48

[52] U.S. Cl. ..... 10/7; 10/26

[58] Field of Search ..... 10/3, 5, 7, 10 R, 19, 10/24, 26, 27 R; 85/45

[56] References Cited

U.S. PATENT DOCUMENTS

| | | | |
|---|---|---|---|
| 2,182,092 | 12/1939 | O'Leary | 10/10 R |
| 2,304,704 | 12/1942 | O'Leary | 85/45 |
| 2,676,510 | 4/1954 | Hodell | 85/45 |
| 2,677,985 | 5/1954 | Vaughn | 85/45 |
| 2,954,719 | 10/1960 | Vaughn | 85/45 |
| 3,354,481 | 11/1967 | Bergere | 10/10 R |
| 3,388,411 | 6/1968 | Vaughn | 10/10 R |
| 3,453,972 | 7/1969 | Vaughn | 10/7 |
| 3,540,342 | 11/1970 | Vaughn | 85/45 |
| 4,033,003 | 7/1977 | Marroquin | 10/10 R |

*Primary Examiner*—E. M. Combs

*Attorney, Agent, or Firm*—Donald J. Ellingsberg

[57] ABSTRACT

An improved hammer used in the first step of a two-step method for forming an undercut fastener driving slot in the head of a fastener, such as a screw or bolt, that results in an arcuate, recessed high-torque driving slot with undercut slot sidewalls where each sidewall has a noncontinuous sphericity interrupted by an inverted and generally triangular planar surface.

6 Claims, 5 Drawing Figures

HAMMER FOR FORMING AN UNDERCUT FASTENER DRIVING SLOT

CROSS-REFERENCE TO RELATED APPLICATION

Application by Emilio R. Marroquin, Ser. No. 833,539, filed Sept. 15, 1977 even date herewith, for "IMPROVED HEADING METHOD FOR FORMING AN UNDERCUT FASTENER DRIVING SLOT", and assigned to the assignee of the present invention.

BACKGROUND OF THE INVENTION

The history of the development of the prior art as it relates to a high torque fastener driving system is treated in detail in my U.S. Pat. No. 4,033,003 granted July 5, 1977. Whereas U.S. Pat. No. 3,388,411, which issued to Rudolph M. Vaughn, teaches the forming of an arcuate and undercut fastener slot having diverging sidewalls using a method requiring three separate heading blows, the Marroquin method taught by U.S. Pat. No. 4,033,003 requires two separate heading blows. This Marroquin Method One uses a hammer that develops a slot where the lateral bulges of the diverging sidewalls of the slot are continuous and uninterrupted along the entire undercut length of the slot. Although the slot so formed is generally acceptable, the hammer used in the first step of the Marroquin Method One does not develop an undercut fastener driving slot that conforms geometrically and visually to the RECESS-HI-TORQUE of MILITARY STANDARD MS 33750. Similarly, the hammer used in the Bergere method taught by U.S. Pat. No. 3,354,481 granted Nov. 28, 1967 does not develop a bowtie or "butterfly" slot that conforms exactly with the requirements of MS 33750.

OBJECTS OF THE INVENTION

Accordingly, it is an object of the invention to provide a new and improved hammer for forming an undercut fastener driving slot by heading.

It is an object of the invention to provide a first hammer for use in a two-step heading method for forming a fastener driving slot having an undercut and diverging sidewall configuration with each sidewall having a noncontinuous sphericity.

SUMMARY OF THE INVENTION

Briefly, in accordance with the invention, an improved hammer for forming an undercut fastener driving slot in the head of a fastener is provided comprising planar means to form a primary surface of the fastener, convex plateau means to form an undercut and diverging slot recessed below the primary surface with each slot sidewall having a noncontinuous sphericity developed by planar triangular means on the convex plateau means, convex partial sphere means to form a speed dimple on either side of the slot, and concave spherical-triangle wedge means to form tandem pairs of spaced-apart bulges of fastener material.

While the specification concludes with claims particularly pointing out and distinctly claiming the subject matter which may be regarded as the invention, the organization and method of operation, together with further objects, features, and the attending advantages thereof, may best be understood when the following description is read in connection with the accompanying drawing.

DESCRIPTION OF THE INVENTION

Figure 1:
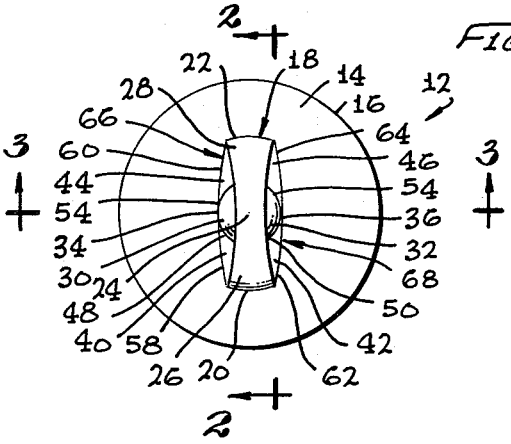
FIG. 1 is a plan view of the improved hammer of the present invention.
Figure 2:
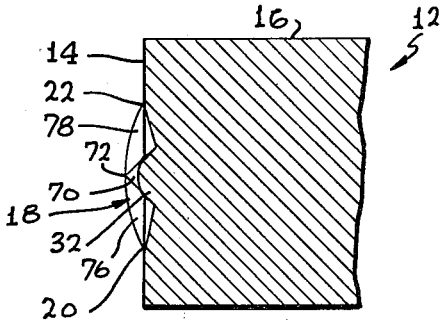
FIG. 2 is a sectional view, partly broken away, of the hammer of FIG. 1 along the line 2—2.
Figure 3:
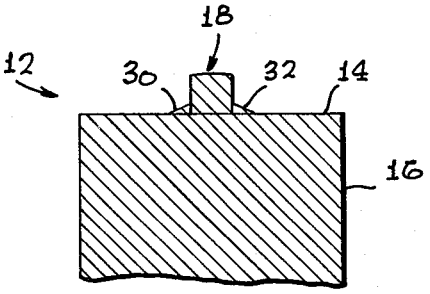
FIG. 3 is a sectional view, partly broken away, of the hammer of FIG. 1 along the line 3—3.

The improved hammer 12 of the present invention as shown by FIGS. 1 through 3, and in particular by FIG. 1, has a primary surface 14 that is preferably planar and which establishes a reference bench mark for the positive and negative elevations of the several hammer tool surfaces described hereinafter.

One tool surface means on the hammer body 16 is a convex plateau 18 that extends both longitudinally between spaced-apart lines of origin 20 and 22, and to a maximum positive elevation above the primary surface 14 at an intermediate region of reduced lateral dimension 24. The lines of origin 20 and 22 are at the reference bench mark or zero elevation of the primary surface 14, where the plateau 18 has its regions of maximum lateral dimension 26 and 28, respectively. That is, the plateau 18 flares to a greater transverse dimension at each of the regions 26 and 28 relative to the smaller transverse dimension at the intermediate region 24.

A second tool surface means on the hammer body 16 are convex partial spheres 30 and 32 that extend to a positive elevation above the primary surface 14 but at an elevation that is less than the maximum positive elevation of the intermediate region 24. Convex partial sphere 30 develops a merger line 34 at the zero elevation of the primary surface 14, while convex partial sphere 32 develops a similar merger line 36. The convex partial spheres 30 and 32 are positioned on opposite sides of and spaced-apart by the convex plateau 18 at the intermediate region 24 as shown by FIGS. 1 and 3. It is preferred that each of the merger lines 34 and 36 is relatively short so that the geometry of each more nearly reflects a tangential merger point.

A third tool surface means on the hammer body 16 are concave, wedge-like depressions having a generally spherical triangle geometry. These concave wedges 40, 42, 44, and 46 extend from a zero elevation at the lines of origin 20 and 22 to a negative elevation below the primary surface 14 that reaches a maximum depth adjoining the convex partial spheres 30 and 32 where each sphere extends below the primary surface; these junction lines between the wedges and the spheres are shown by FIG. 1 and identified as 48, 50, 52, and 54, respectively. Concave wedges 40 and 42 as a pair are spaced-apart by the convex plateau 18 juxtaposed therebetween, and concave wedges 44 and 46 are similarly paired.

The paired concave wedges (40, 42) and (44, 46) have adjacent concave wedges 40 and 44 merging with the juxtaposed convex sphere 30, and adjacent wedges 42 and 46 merging with the juxtaposed convex sphere 32. This merging by the adjacent ones of the concave wedges is with the associated convex sphere at the respective merger lines 34 and 36 as described hereinbefore. Outer edges 58 and 60 of adjacent wedges 40 and 44, respectively, are at the zero elevation of the primary surface 14 with outer edge 58 extending from merger line 34 to the line of origin 20, and with outer edge 60 extending from the merger line to the line of origin 22. A similar pair of outer edges 62 and 64 of adjacent wedges 44 and 46, respectively, extend from the central or intermediate merger line 36 to the respective lines of origin 20 and 22 as shown by FIG. 1. The paired outer edges (58, 60) and (62, 64) complement the respective merger lines 34 and 36, and develop ellipsoidal lines 66 and 68 of elevational demarcation between the zero elevation of the primary surface 14 and both the negative elevation of the concave wedges 40, 42, 44 and 46, and the positive elevation of not only the convex spheres 30 and 32 but also the convex plateau 18.

A fourth tool surface means on the hammer body 16 are planar and generally triangular surfaces on opposite sides of the convex plateau 18 at the intermediate region 24 and adjacent the respective convex spheres 30 and 32. One of the two similar triangular surfaces, planar triangular surface 70, is shown by FIG. 2. The triangular surface 70 has its apex 72 at the point of maximum positive elevation of the intermediate region 24, and has as its base the spherical portion 74 of the associated convex sphere, here convex sphere 32. The adjacent side surfaces 76 and 78 of the convex plateau 18 are arcuate, conforming to the flared dimension of the convex plateau at its region of maximum lateral dimension 26 and 28 as described hereinabove. It is understood that the opposite side of the convex plateau, although not shown, is similar to the side as illustrated by FIG. 2 and described above.

Figure 4:
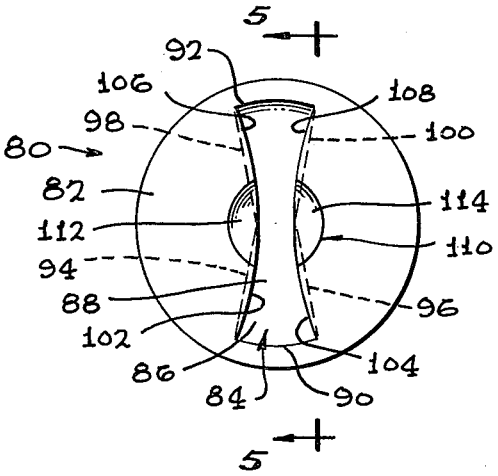
FIG. 4 is a plan view of the head of a fastener formed in part by the hammer of the present invention.
Figure 5:
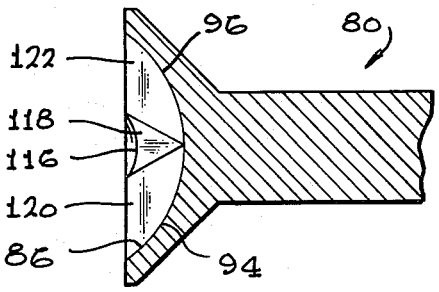
FIG. 5 is a sectional view of the fastener head of FIG. 4 along the line 5—5 which includes a portion of the fastener body.

The hammer 12 of the invention as described produces the completed fastener head 80 as shown by FIGS. 4 and 5. The completed fastener head 80 has a flat top surface 82 and an undercut fastener driving slot 84 which is recognizable as a conventional high torque recess such as that of MS 33750.

The fastener slot 84 has an arcuate surface 86 as shown by FIG. 5 that has a preferred flat bottom 88 as shown by FIG. 4. The flat bottom 88 dimensionally flares transversely outwardly with reference to the longitudinal axis of the slot 84 reaching its maximum at each of the slot ends 90 and 92 which are at the zero elevation of the top surface 82. The edges 94, 96, 98, and 100 of the flat bottom 88 are shown in phantom and appear to be straight lines when viewed in plan as shown by FIG. 4. However, these bottom edges are arc segments and are undercut with reference to the respective parabolic surface edges 102, 104, 106, and 108 of the slot. Although the bottom edges 94, 96, 98, and 100 are uninterrupted between the respective slot ends 90 and 92, the parabolic slot edges 102, 104, 106, and 108 are interrupted by a concave speed dimple 110 which is specified for the high-torque fastener of MS 33750. Thus, slot edges 102 and 104 are interrupted by the concave hemisphere portion 112 of the speed dimple, and slot edges 106 and 108 are interrupted by the concave hemisphere portion 114. Each of the concave hemisphere portions 112 and 114 develop the curved baseline of a planar, generally triangular surface; for example, hemisphere portion 112 develops the curved baseline 116 of the triangular plane 118 as shown by FIG. 5. It is understood that hemisphere portion 114 develops a similar curved baseline for a triangular plane in the opposing slot sidewall. These triangular planes, such as triangular plane 118, form opposite parallel planes with their opposed walls parallel to the longitudinal axis of the slot 84. Note that the triangular planes, such as triangular plane 118, form an inverted triangle with its apex at the junction or midpoint of the associated bottom edges; here the bottom edges 94 and 96 associated with triangular plane 118. The spherical triangle portions 120, 122, 124, and 126, with spherical triangle portions 120 and 122 more clearly shown by FIG. 5, are canted to converge inwardly thereby developing the desired undercut configuration of this high torque fastener recess slot.

The resulting completed fastener slot 84 and fastener head top surface 82 with the speed dimple 110 as formed in part by the hammer 12 of the invention are both geometrically and visually identical to the requirements of MS 33750.

As will be evidenced from the foregoing description, certain aspects of the invention are not limited to the particular details of construction as illustrated, and it is contemplated that other modifications and applications will occur to those skilled in the art. It is, therefore, intended that the appended claims shall cover such modifications and applications that do not depart from the true spirit and scope of the invention.

I claim:

1. A hammer for forming a fastener slot in a fastener head comprising:

(a) a primary surface, (b) longitudinally-extending convex plateau defining a longitudinal axis having spaced-apart lines of origin generally transverse to said axis and common with said primary surface between said lines of origin to an intermediate region of maximum elevation from said primary surface, (c) said plateau having a reduced dimension transverse to said plateau longitudinal axis at said region of maximum elevation and dimensionally flaring transversely outwardly in opposite directions to a greater transverse dimension at each of said lines of origin, (d) spherical convexities adjacent said reduced dimension extending outwardly from said primary surface to a maximum elevation above said primary surface but less than the elevation of said plateau region of maximum elevation, said spherical convexities spaced-apart by said plateau in juxtaposition therewith, (e) concave spherical-triangle wedges extending along and adjacent to said plateau, and extending below said primary surface from said lines of origin to said spherical convexities, said wedges coupled in pairs with the paired ones of said wedges spaced-apart by said plateau in juxtaposition therewith, (f) adjacent ones of said paired wedges merging with a juxtaposed one of said spherical convexities therebetween at a merger line, (g) an outer edge of each of said adjacent ones of said paired wedges extending from said merger line to an associated one of said lines of origin, said outer edges of said adjacent ones of said paired wedges and said merger line developing an ellipsoidal line of elevational demarcation between said primary surface and the said paired wedges and juxtaposed spherical convexity, and (h) a planar and generally triangular surface on each of the opposite sides of said convex plateau at said intermediate region extending between and adjacent to said maximum elevation of said intermediate region and said associated one of said convex partial spheres, said triangular surfaces interrupting the continuity of said opposite sides.

2. The hammer of claim 1 in which said primary surface is planar.

3. The hammer of claim 1 in which said spherical convexities are a pair of partial spherical convexities spaced-apart by said plateau.

4. The hammer of claim 1 in which said merger line between said paired wedges and said juxtaposed one of said spherical convexities is common with said primary surface.

5. The hammer of claim 4 in which said merger line is a tangential merger point.

6. The hammer of claim 1 in which each of said triangular surfaces has its apex at said maximum elevation of said intermediate region.

* * * * *